US005630555A

United States Patent [19]

Boyd

[11] Patent Number: 5,630,555

[45] Date of Patent: May 20, 1997

[54] ROCK CRUSHER

[75] Inventor: Phillip G. Boyd, Waihi, New Zealand

[73] Assignee: Boyd Motors Limited, Waihi, New Zealand

[21] Appl. No.: 509,731

[22] Filed: Aug. 1, 1995

Related U.S. Application Data

[63] Continuation of Ser. No. 190,232, Jan. 31, 1994, abandoned, which is a continuation of Ser. No. 54,466, Apr. 28, 1993, abandoned, which is a continuation of Ser. No. 880,739, May 8, 1992, abandoned.

[51] Int. Cl.[6] ..... B02C 1/02

[52] U.S. Cl. ..... 241/29; 241/201; 241/266; 241/267

[58] Field of Search ..... 241/201, 219, 241/266, 267, 30, 29

[56] References Cited

U.S. PATENT DOCUMENTS

| | | | |
|---|---|---|---|
| 55,181 | 5/1866 | Wagner | 241/201 |
| 962,998 | 6/1910 | Chust | 241/201 |
| 4,406,412 | 9/1983 | Alexandersson | 241/266 X |
| 4,765,546 | 8/1988 | Stewart | 241/266 X |

FOREIGN PATENT DOCUMENTS

| | | | |
|---|---|---|---|
| 1006699 | 4/1957 | Germany | 241/266 |
| 1962867 | 7/1971 | Germany | 241/266 |
| 1457989 | 2/1989 | U.S.S.R. | 241/266 |
| 805030 | 11/1958 | United Kingdom | 241/266 |

*Primary Examiner*—Frances Han
*Attorney, Agent, or Firm*—Abelman, Frayne & Schwab

[57] ABSTRACT

This invention relates to improvements and modifications to a rock crusher. The rock crusher has at least two jaws the jaws being driven at different ends to each other. The non-driven end of at least one jaw is sufficiently free to allow vertical movement of that jaw with respect to the other jaw. This vertical movement imparts a grinding action in addition to the crushing action of the rock crusher. This removes the problems which can occur with wadding and can produce a very fine ground rock.

11 Claims, 4 Drawing Sheets

ROCK CRUSHER

This application is a Continuation application under 37 C.F.R. 1.62 of prior application Ser. No. 08/190,232, filed on Jan. 31, 1994, which is a continuation of Ser. No. 08/054,466 filed Apr. 28, 1993, which is a continuation of Ser. No. 07/880,739 filed May 8, 1992 which are all abandoned.

This invention relates to a rock crusher and to a method of rock crushing. It should be appreciated that the term rock is used throughout the specification as meaning any hard material able to be crushed or ground.

Rock crushers come in a variety of types and sizes and can range from rock crushers used to crush large boulders into gravel to laboratory ore crushers that crush ore samples to particles under 2 mm in diameter.

One type of traditional rock crusher has a fixed jaw plus a sloped jaw, the upper part of the sloped jaw being driven by a cam towards and away from the fixed jaw. There is little movement at the base of the driven jaw which is anchored by toggle plates.

Another type of rock crusher has a swing jaw whereby the two jaws are pivotably mounted at the top of the jaws and driven simultaneously towards and away from each other. The movement of the jaws in both of these rock crushers exert a crushing action on the ore introduced into them.

Unfortunately, these rock crushers have problems associated with them. One major problem is obtaining a sufficiently fine sample. Presently the ore to be crushed will need to be passed through existing crushers in the order of six times or so to be reduced to the desired size.

Another problem is that the toggle plates used wear considerably. Furthermore toggle plates cannot be readily oiled and are therefore uncomfortably noisy.

A further problem, particularly associated with swing jaw crushers, when used for laboratory work is that the crushed material tends to wad between the jaws, that is, the fine particles tend to pack together. Not only are these wadded soft samples unsuitable for the purpose required they cause considerable strain on the cam shafts that drive the jaws. The strain on the cam shafts is due to the cams attempting to push the jaws together to compress the uncompressable wadded particles.

It is an object of the present invention to address the above problems.

Further objects and advantages of the present invention will become apparent from the following description which is given by way of example only.

SUMMARY OF THE INVENTION

According to one aspect of the present invention there is provided a rock crusher with at least two jaws, the jaws being driven at different ends to each other wherein the non-driven end of at least one jaw is sufficiently free to allow vertical movement of that jaw with respect to the other jaw.

According to another aspect of the present invention there is provided a rock crusher with at least two jaws wherein at least one of the jaws is biased against a roller.

Reference to the term roller throughout this specification shall mean a device capable of circular motion.

According to yet another aspect of the present invention there is provided a rock crusher with at least two jaws wherein the lower part of each of the jaws comprise substantially straight grinding surfaces.

According to a different aspect of the present invention there is provided a rock crusher wherein the operation of the upper and lower ends of the jaws is timed with respect to each other.

According to another aspect of the present invention there is provided a method of reducing rocks to a smaller size characterised by the step of first crushing the rocks to an initial size and then subjecting the crushed rocks to a crushing and grinding action to reduce the rocks to a smaller size.

A method of crushing rocks characterised by the step of introducing the rocks to the jaws of a rock crusher, wherein the rock crusher jaws have an upper portion and a lower portion wherein there is a vertical component in movement of the lower portion of both jaws.

According to an alternative aspect of the present invention there is provided a jaw for a rock crusher comprised of an upper portion and a lower portion, both portions being angled with respect to each other.

GENERAL DESCRIPTION OF THE INVENTION

The applicant believes that providing a crushing plus a grinding action of the jaws for a rock crusher reduces the rock placed within the rock crusher to a finer size than was previously obtainable with rock crushers that merely crushed without grinding.

In one embodiment of the present invention, the two jaws are symmetrical about a vertical axis. The upper parts of the jaws may diverge from each other forming a in cross-section substantially funnel shape. The lower parts of the jaws may be substantially parallel to each other. It is envisaged that the upper parts of the jaws will do the bulk crushing of the rock or ore and that the lower parts of the jaws would have a crushing action plus a grinding action.

In most embodiments, it is envisaged that the surfaces of the jaw be substantially smooth, however in some embodiments there may be included a roughened surface which could vary according to the type of rocks to be crushed. The surface may even be of a composition which aids in the direction of the ore downwards, perhaps for instance there may be included downwardly sloping teeth.

To ensure that the lower parts of the jaw have a grinding action, it is necessary for the jaws to have a substantially vertical movement with respect to each other. The toggle plates in previous devices did allow some vertical movement but a considerable part of the movement was transformed to radial motion. Toggle plates are also subjected to considerable wear and are very noisy when the rock crusher is in operation.

In one embodiment of the present invention, the applicant does not have toggle plates at the non-driven end of the jaw but has instead rollers. In preferred embodiments there would be a roller at each non-driven end of the jaws, however it should be appreciated that in some embodiments only one non-driven end of a single jaw would be biased against a roller. A roller has number of advantages over toggle plates as it allows maximum vertical movement of the jaw biased against it as well as having minimal wear and being considerably less noisy than toggle plates.

The jaws may be biased against the rollers by a number of means. In one embodiment the jaws may be biased with a tension spring.

One method of crushing rocks in accordance with the present invention is described below.

The upper part of one jaw may be driven as well as the lower part of the other jaw. One means for driving the jaws may be by use of eccentric cams, although other driving means may of course be used. The upper parts of the jaws may act to crush the ore being introduced into the rock crusher whereas the lower parts of the jaw will be used to crush and grind the ore previously crushed above to fine particles of the desired size. It is envisaged that the shapes of the jaws and the action of the cams will cause the upper parts of the jaws to move together and away from each other in a substantially horizontal motion. The lower parts of the jaws would also move towards and away from each other but as well would have a vertical motion as a result of the non-driven ends of the jaws being free to move on the rollers. The vertical motion of the lower parts of the jaws acts to grind the ore introduced between the jaws in addition to the crushing action caused by the horizontal movement.

In some embodiments it may be difficult for the lower parts of the jaw to cope with the amount of material emerging from the upper parts of the jaw, if the upper and lower parts of the jaw are being driven at the same rate. In one embodiment of the present invention, the lower part of the jaw will be driven at a rate twice that of the upper part of the jaw. Other ratios of the rates may be used.

It is considered important that the timing of the motion of the upper part of the jaw compared to the lower part of the jaw is accurate. The lower jaws may in some embodiments have two crush points where the jaws come together so that for every crush of the upper half of the jaw, the lower half may crush twice. The timing of the jaws may be achieved by a number of means and in one embodiment this may be achieved by the use of a toothed drive belt on the driving means for the jaws. It is preferable that the timing is such that as one jaw moves upwards, the other jaw comes down thus giving a maximum possible frictional surface area between which the jaws can interact and grind the ore.

Tests on a rock crusher in accordance with the present invention have shown that it can crush ore to the desired size with one pass of the ore through the crusher in comparison with the six or so passes required in traditional rock crushers. The use of rollers in the present invention means that it suffers less wear than traditional rock crushers and that it is considerably less noisy.

Another advantage of using rollers instead of toggle plates is that the jaws can be easily opened out for cleaning of the jaws. In the past, toggle plates prevent this from being readily achievable. By having jaws tensioned against rollers means that the jaws can be readily readjusted. For instance, one or more of the rollers may be positioned on a shaft with an adjusting bolt which can move the roller(s) and hence the jaw(s) to an appropriate distance from the other jaw when the jaws are substantially stationary.

DETAILED DESCRIPTION OF THE INVENTION

Aspects of the present invention will now be discussed by way of example only with reference to the accompanying figures in which.

Figure 1:
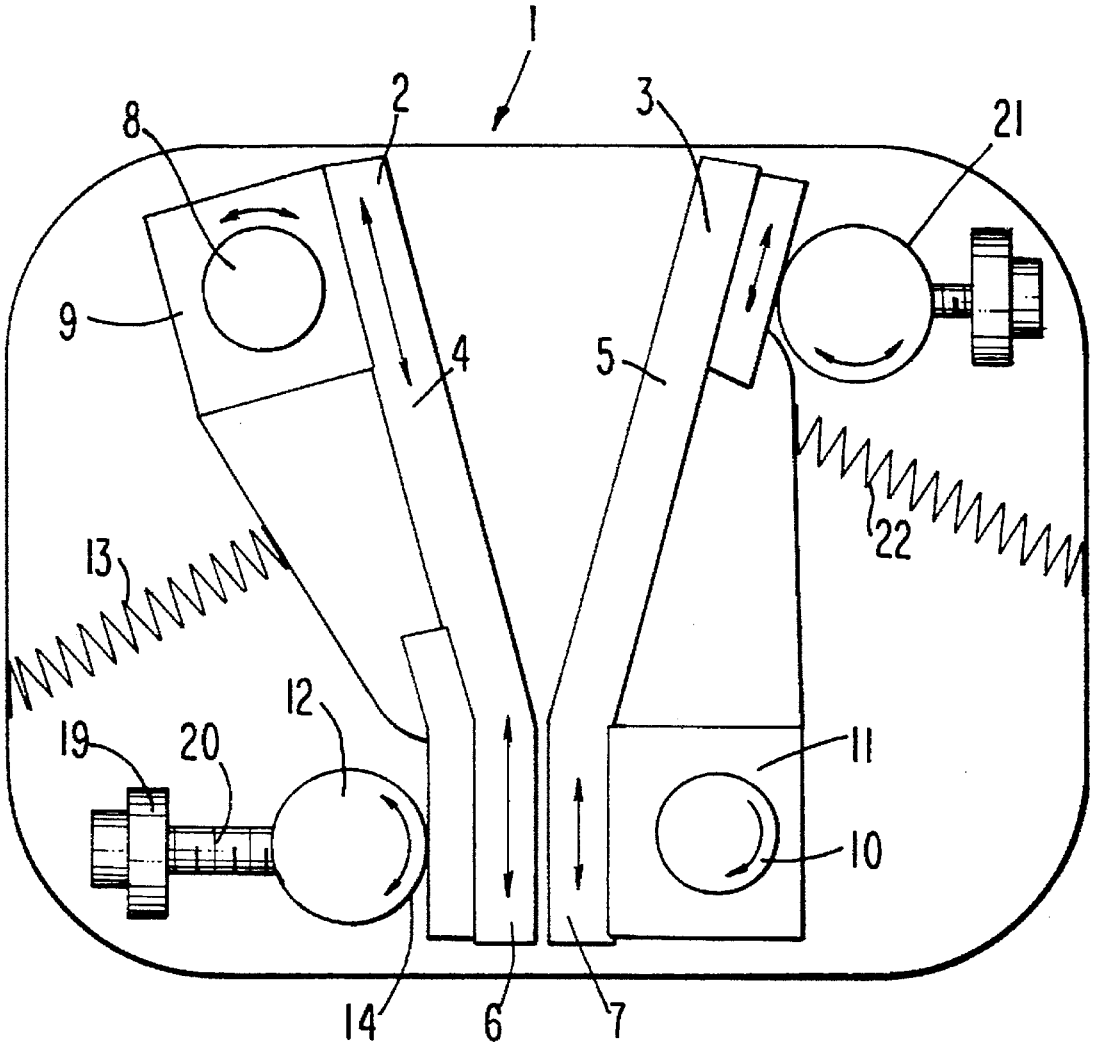
Figure 2A:
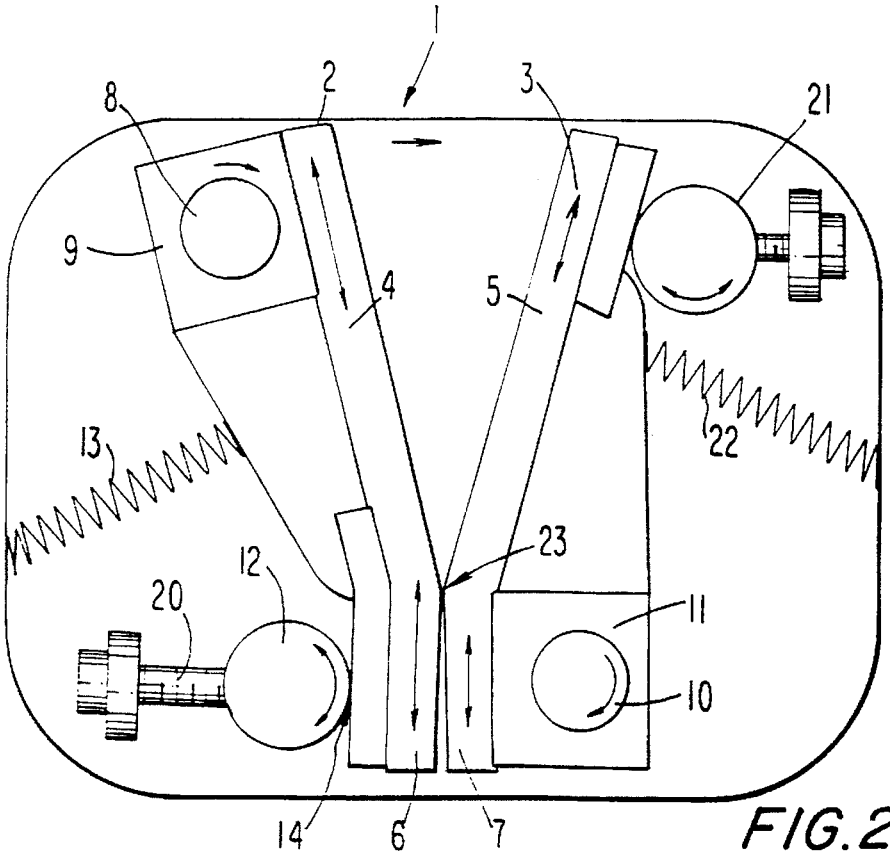
Figure 2B:
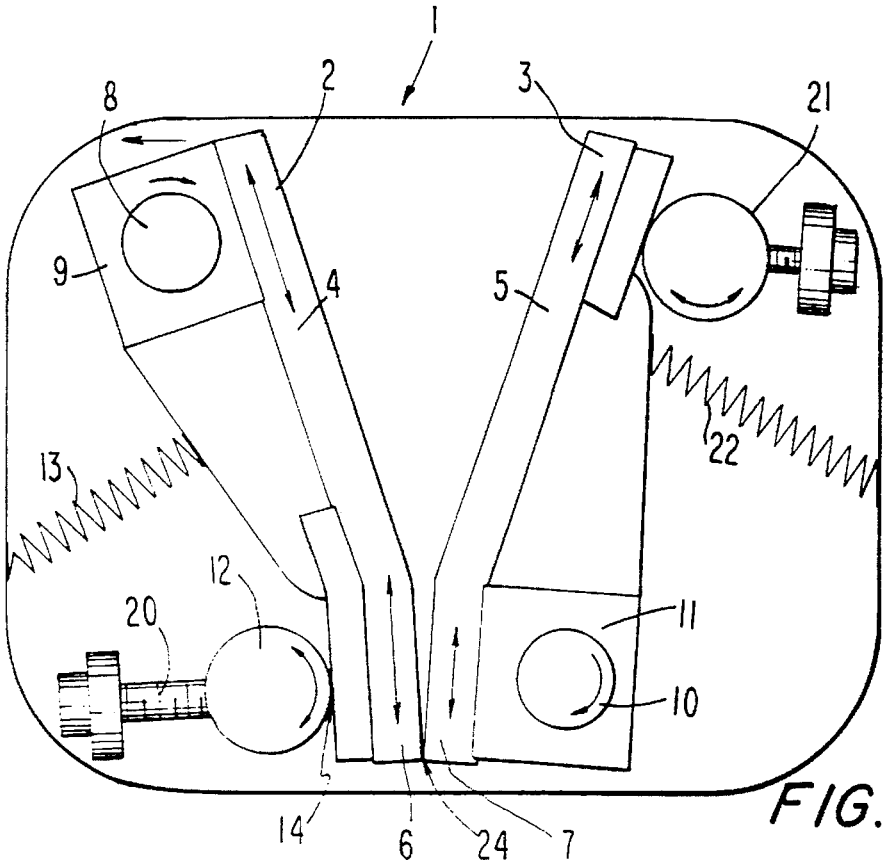
Figure 3:
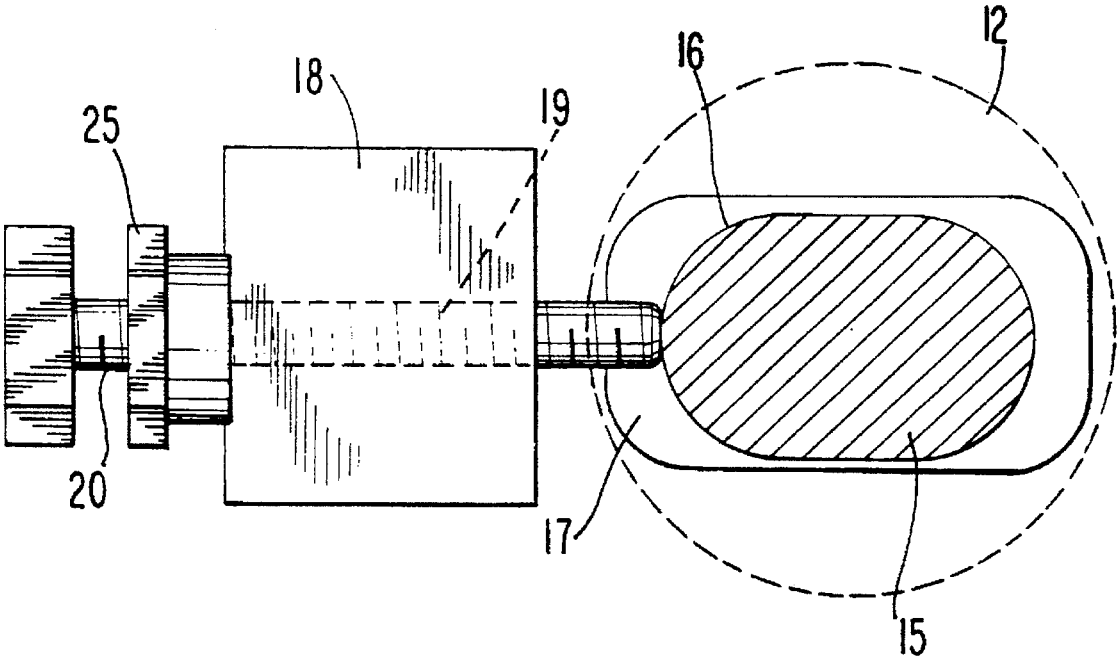

FIG. 1: is a diagrammatic side view of a rock crusher in accordance with one embodiment of the present invention, and FIG. 2 with FIGS. 2*a* & 2*b*: shows the relative crushing of the upper part and lower part of the jaws to each other, and FIG. 3: illustrates one means by which the absolute distance between the jaws can be adjusted.

Figure 4:
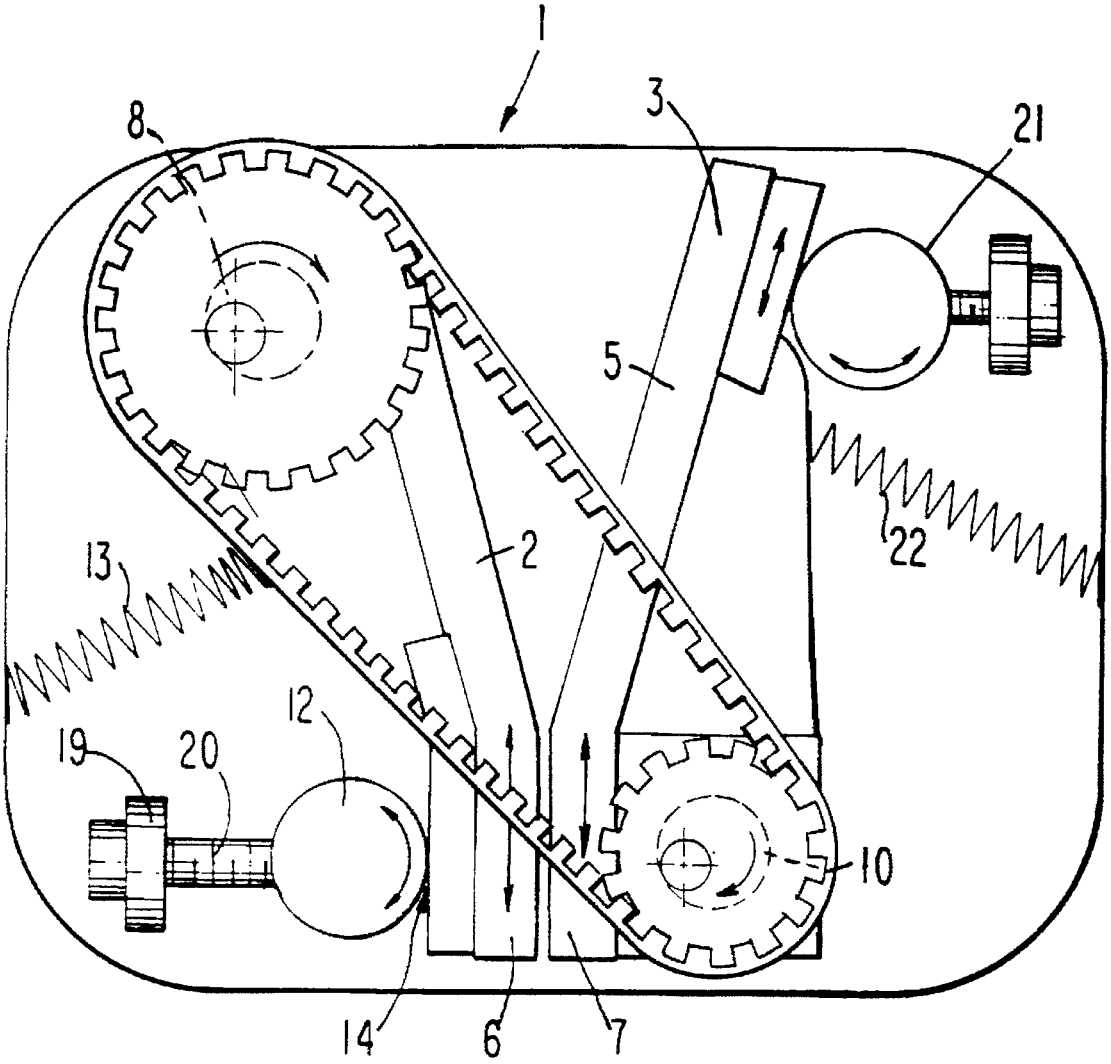

FIG. 4 illustrates a toothed belt employed for driving cams of the apparatus

With respect to FIG. 1, there is illustrated a rock crusher generally indicated by arrow 1 comprising a first jaw 2 and a second jaw 3. In the present embodiment, the desired ore particle size is 2 mm or under as this rock crusher crushes ore for laboratory sampling.

The upper parts 4 and 5 of jaws 2 and 3 respectively are slightly corrugated and have their planar surfaces angled at approximately 20° to each other. The lower parts 6 and 7 of the jaws 2 and 3 respectively are also flat and planar, but positioned substantially parallel to each other. The length of the jaws is approximately 390 mm and the distance between the upper parts 4 and 5 of the jaws 2 and 3 is approximately 120 mm.

An eccentric cam 8 drives the upper part 4 of the jaw 2. The cam 8 has a 50 mm shaft and a 55 mm eccentric bush which acts to move the cam 8 a total distance of 5 mm. The cam 8 is situated within a cam block 9.

An eccentric cam 10 which is on the lower part 7 of the jaw 3 has a diameter of 50 mm and a 52 mm eccentric bush. This moves the lower part 7 of the jaw 3 in and out a distance of 2 mm. The cam 10 is situated within a cam block 11.

The first jaw 2 is tensioned against a free roller 12 with a spring 13. The pivot point of the jaw 2 on the roller 12 is indicated by arrow 14.

Referring specifically to FIG. 3, the roller 12 (as is roller 21) revolves on shaft 15. Shaft 15 has flats 16. The shaft 15 passes through a slot 17 and movement of the shaft 15 in the slot 17 causes the roller 12 to likewise move.

Adjacent the slot 17 is a block 18 with a threaded aperture 19. Passing through the threaded aperture 19 is a bolt 20, the end of which butts the roller shaft 15. To move the position of the first jaw with respect to the second jaw, the lock nut 25 is released and bolt 20 is turned causing the roller 12 to move. The jaw 2 which is biased against the roller 12 is also moved.

In some embodiments (not shown) there may be a quick release system consisting a shaft and cams with an air ram to allow the jaw 2 to swing away from jaw 3 to assist in the cleaning of the jaws.

The second jaw 3 is tensioned against a roller 21 by a spring 22. The upper part 5 of the jaw 3 is essentially fixed in a horizontal direction which means that its motion on the roller 21 is substantially vertical as shown by the arrows. Adjusting the position of the roller 21 in a similar manner to roller 12 will alter the angle between the lower jaw parts 6 and 7. This can change the crushing points of these surfaces.

The cam 8 rotates at a speed of 350 revolutions per minute whereas the cam 10 rotates at 700 revolutions per minute giving a timing ratio between the upper parts 4 and 5 and lower parts 6 and 7 of 1:2. This timing ratio may be different in other jaws, perhaps 1:4 and can depend upon the geometry of the upper parts of the jaws compared with the lower parts of the jaws. The rotational speed of the cams 8 and 10 may also be varied.

It can be seen from the arrows in FIG. 1 that the direction of movement of the jaw to each other is both horizontal giving a crushing action and vertical giving a grinding action, particularly with respect to the lower parts of the jaws 6 and 7.

FIG. 2 illustrates the relative positions of the upper parts 4 and 5 and the lower parts 6 and 7 of the jaws 2 and 3 to each other during a typical cycle. It should be appreciated that the timing of the jaws 2 and 3 to each other can be critical to the operation of the rock crusher. In this embodiment the timing of the jaws 2 and 3 is achieved by a toothed belt drive 24, 26 which runs the cams 8 and 10. A double ended drive motor is used to drive each end of the cams 8 and 10 to reduce torsional strain on the cam shaft which occurs if only one end of the cams is driven. This also keeps an even pressure on the bearings at all times.

FIG. 2A illustrates the first part of the cycle. The upper part 4 of the jaw 2 is driven by cam 8 to move a total distance of 5 mm towards the upper part 5 of the jaw 3. The pivot point is indicated by arrow 14. This motion acts to crush larger rock samples between the upper parts of the jaws 4 and 5. At the same time as the upper jaws 4 and 5 are moving towards each other, the lower part 6 of jaw 4 pivots about point 14 and the lower part 7 of jaw 3 is driven forward by cam 10. This gives a crushing point on the lower parts 6 and 7 as indicated by arrow 23. At the same time, the jaw 3 has a substantially vertical motion from its interaction with roller 21 which imparts a grinding motion between the lower jaw parts 6 and 7. As the lower jaw part 6 moves downwards the lower jaw part 7 moves upwards and vice versa giving a maximum possible grinding effect.

In the second part of the cycle, the upper part 4 of the jaw 2 is moving away from the upper part 5 of the jaw 3 as a result of the action of the cam 8. The lower part 6 of the jaw 4 still pivots around pivot point 14. The pivoting action along with the timed driving action of the cam 10 on the lower part 7 of the jaw 3 causes a second crush point 24 at the bottom of the jaws 2 and 3.

It should be appreciated that jaw 2 has a greater vertical movement than jaw 3 as a result of jaw 2 moving 5 mm for every 2 mm jaw 3 moves. The action of jaw 2 is such that it forces ore downwards between the jaws, whereas jaw 3 tends to push ore upwards.

Thus, for every cycle there is one crushing of the ore by the upper parts 4 and 5 of the jaws 2 and 3 and two crushings of the ore by the lower parts 6 and 7. This is achieved by the ratio of speed of the cams 8 and 10 to each other, the shapes of the jaws 2 and 3, the relevant pivot points resulting from the placement of the rollers 12 and 21 and the timing of the action of the jaws to each other which is brought about by the use of a toothed belt drive. Not only do the lower parts 6 and 7 of the jaws crush twice as fast as the upper parts 4 and 5, the substantially parallel flat surfaces of the lower parts 6 and 7 of the jaws and the vertical movement of the jaws 2 and 3 means that the lower parts 6 and 7 also have a grinding action. These features along with the downward pressure of jaw 2 on the ore ensure that ore introduced to the rock crusher need only be passed through the rock crusher once to get reduction of the ore to particles of the desired size.

Aspects of the present invention have been discussed by way of example only and it should be appreciated that modification and additions may be made thereto without departing from the spirit or scope thereof.

I claim:

1. A method of crushing rocks in a rock crusher, said rock crusher having a first jaw and a second jaw, wherein each of said first jaw and said second jaw have an upper portion and a lower portion, said first jaw and said second jaw being arranged to allow movement of said first jaw and said second jaw with respect to each other, the movement including pivoting of at least one jaw of said first jaw and said second jaw about a pivot point, the movement of said first jaw and said second jaw resulting in an upper portion of said first jaw and an upper portion of said second jaw having a crushing action when in operation and a lower portion of said first jaw and a lower portion of said second jaw having at least two crush points when in operation, said method of crushing rocks comprising the steps of:

introducing rocks between said first jaw and said second jaw;

crushing certain of said rocks which are larger than others of said rocks between said upper portion of said first jaw and said upper portion of said second jaw by said crushing action; and crushing said rocks between said lower portion of said first jaw and said lower portion of said second jaw at said at least two crush points.

2. In an apparatus for crushing rock, of the type including:

a first elongate crushing jaw having an upper portion and a lower portion;

a second elongate crushing jaw having an upper portion positioned in proximity to said upper portion of said first jaw, and having a lower portion positioned in proximity to said lower portion of said first jaw;

a means positioned adjacent said upper portion of said first jaw for oscillating said upper portion of said first jaw in an orbital path;

a means positioned adjacent said lower portion of said second jaw for oscillating said lower portion of said second jaw in an orbital path:

means associated with said lower portion of said first jaw permitting movement of said first jaw in a substantially linear path; and means associated with said upper portion of said second jaw permitting movement thereof in a substantially linear path;

the improvement comprising:

a first drive means for oscillating said first jaw at one speed of oscillation; and a second drive means for oscillating said second jaw at a speed of oscillation different from that of said first jaw;

said first and second drive means being operative to cause said upper portions of said first and second jaws to move relative to each other at one speed of movement, and to cause said tower portions of said first and second jaws to move relative to each other at a speed of movement different from that of said upper portions, and, to cause said first jaw to move longitudinally at a speed of movement different from that of the longitudinal movement of said second jaw;

whereby, said first and second jaws are moved in paths dissimilar from each other and out of parallelism with each other, thus to sequentially produce a crushing action between said upper portion of said first jaw and said upper portion of said second jaw; and at least two crush points between said lower portion of said first jaw and said lower portion of said second jaw.

3. The rock crusher as claimed in claim 2, wherein at least one of said jaws is biased against a roller.

4. The rock crusher as claimed in claim 2, wherein said upper portions of said first and second jaws diverge from each other so that in cross-section said upper portions form a substantially funnel shape.

5. The rock crusher as claimed in claim 2, wherein said lower portions of said first and second jaws comprise substantially flat and straight grinding surfaces.

6. The rock crusher as claimed in claim 2, wherein operation of said upper and lower portions of said first and second jaws is timed with respect to each other.

7. The rock crusher as claimed in claim 6, wherein the timing of the operation of said upper and lower portions of said first and second jaws with respect to each other is controlled by a toothed belt connected to said first and second drive means.

8. The rock crusher as claimed in claim 6, wherein the timing of said first and second jaws is such that as one jaw moves upwards, the other jaw moves downwards, thus giving a maximum possible frictional surface area between which said first and second jaws can interact and grind rock.

9. The rock crusher as claimed in claim 2, wherein a non-driven end of one of said first and second jaws is biased against a roller.

10. The rock crusher as claimed in claim 2, wherein said first drive means and said second drive means each comprise an eccentric cam.

11. The rock crusher as claimed in claim 2, wherein there is provided means to adjust the position of said first and second jaws with respect to each other when said first and second jaws are in a stationary position.

* * * * *